United States Patent [19]

Ahroni

[11] 4,309,068

[45] Jan. 5, 1982

[54] FUSED PLUG ASSEMBLY WITH SPARE FUSE ELEMENTS

[76] Inventor: Joseph M. Ahroni, P.O. Box 3907, Seattle, Wash. 98124

[21] Appl. No.: 100,410

[22] Filed: Dec. 5, 1979

[51] Int. Cl.[3] ..... H01R 13/68

[52] U.S. Cl. ..... 339/147 P; 337/198; 337/297

[58] Field of Search ..... 339/147, 195, 196, 206 P, 339/157 C; 337/197, 198, 297, 194, 211, 212, 220, 257, 293, 295

[56] References Cited

U.S. PATENT DOCUMENTS

| | | | |
|---|---|---|---|
| 2,462,934 | 3/1949 | Athey | 339/147 P |
| 2,640,184 | 5/1953 | Bauer | 339/195 R |
| 3,585,556 | 6/1971 | Hingorany et al. | 337/297 |
| 3,715,698 | 2/1973 | Blewitt | 337/297 |
| 4,080,039 | 3/1978 | Ahroni | 339/147 R |
| 4,208,645 | 6/1980 | Harmon et al. | 337/297 |

*Primary Examiner*—John McQuade

*Attorney, Agent, or Firm*—Seed, Berry, Vernon & Baynham

[57] ABSTRACT

A fused electrical plug assembly is provided having a plug body with a fuse socket between projecting prongs, and a push-in fuse unit is received in the fuse socket. The fuse unit has an exposed enlarged head for gripping to remove the unit and has one opposite pair of active fuse elements between which there is a spare pair which can be used by removing the fuse unit, turning it ninety degrees, and pushing it back into the fuse socket.

8 Claims, 8 Drawing Figures

FUSED PLUG ASSEMBLY WITH SPARE FUSE ELEMENTS

BACKGROUND OF THE INVENTION

1. Field of the Invention

The present invention relates to fused electrical plugs and particularly to those for use with Christmas tree light sets and other decorative light sets.

2. Description of the Prior Art

Electrical plugs having internal fuses for opening an electrical circuit responsive to excess current flow are in use on decorative light sets. Typical designs are shown in U.S. Pat. Nos. 3,976,967; 4,080,039 and 4,178,061.

Need has arisen for a safe, reliable, cheaper and simpler plug unit having a minimum of parts and in which a fuse is easy to change. There is also a need for a plug unit providing its own spare fuse. The present invention aims to meet these needs.

SUMMARY OF THE INVENTION

In accordance with the present invention the use of fuse carriers and fuse access covers has been eliminated by providing a push-in fuse unit having an enlarged head located between the prongs and which can be gripped for removal. The fuse unit is preferably square in cross-section and has an active pair and a spare pair of fuse elements along its four sides, the active pair engaging two sets of contacts provided by the prong members and the wire leads at opposite sides of a socket receiving the fuse unit. The spares can be put into use by removing the fuse unit from the socket and reinserting it after turning it ninety degrees.

DETAILED DESCRIPTION OF THE INVENTION

Figure 1:
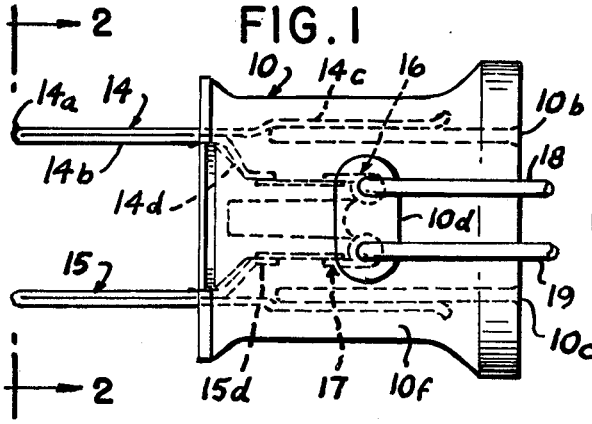
FIG. 1 is a side elevational view of a fused plug assembly embodying the present invention.
Figure 2:
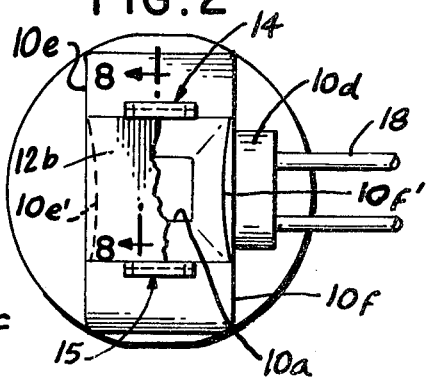
FIG. 2 is a front plan view of the plug assembly with part of the head of the fuse unit broken away and taken as indicated by line 2—2 of FIG. 1.
Figure 3:
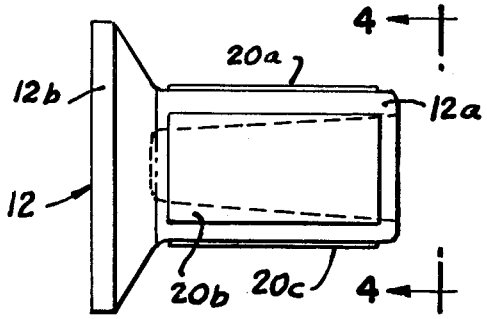
FIG. 3 is an enlarged side elevation view of the fuse unit.
Figure 4:
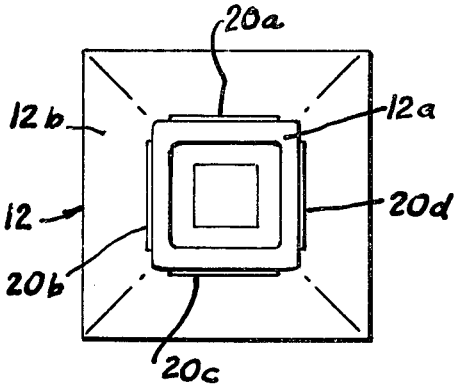
FIG. 4 is a rear plan view of the fuse unit taken as indicated by line 4—4 of FIG. 3.

Referring to the drawings it is seen that the fused plug assembly of the present invention comprises a plug body 10, a push-in fuse unit 12, a pair of prong members 14–15, and a pair of wire contacts 16–17 connected to a pair of leads 18–19. The plug body 10 is formed with a central square fuse receiving socket 10*a* at the front and a pair of standard prong sockets 10*b*, 10*c* at the rear.

The fuse unit 12 has a hollow body 12*a* preferably generally square in transverse cross-section and formed with an enlarged head 12*b*. Two pairs of fuse element strips 20*a–d* extend along the four outer faces of the fuse body 12*a*, one opposite pair 12*a*, 12*c* of these strips electrically interconnecting the prong members 14–15 with the wire contacts 16–17 while the other pair 12*b*, 12*d* remain as spares.

The prong members 14–15 are alike, but positioned with opposite orientation; hence, only prong member 14 will be described in detail. It is formed by doubling back the brass prong stock from the projecting tip 14*a* to form an exposed prong 14*b* of double thickness for insertion into a wall socket or other plug. Within the plug body the prong member has two separated legs, one leg 14*c* being outwardly offset to extend along the outer side of the prong socket 10*b* to engage the respective prong 22 of an add-on plug when plugged into the plug body 10. The other leg is bent inwardly and then rearwardly to provide a contact portion 14*d* exposed to the fuse socket 10*a* near the mouth thereof. This contact portion 14*d* is opposed by a contact portion 15*d* on the opposite side of the fuse socket. The contacts 16–17 are alined with and spaced rearwardly from the contact portions 14*d*, 15*d* so that the fuse elements 20*a*, 20*c* will engage and electrically interconnect the contacts 16–17 with the contact portions 14*d*, 15*d* of the prong members.

Figure 5:
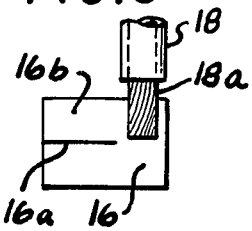
FIG. 5 is a side elevational view of a contact element blank to an enlarged scale.
Figure 6:
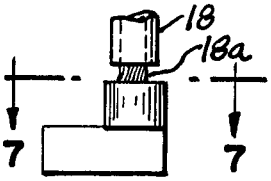
FIG. 6 is a side elevational view of the contact element when attached to a wire lead.
Figure 7:
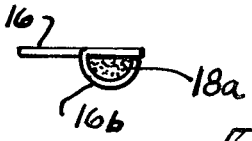
FIG. 7 is taken as indicated in line 7—7 of FIG. 6.

As indicated in FIGS. 5–7, contact 16, for example, is formed by slitting a rectangular brass blank at 16*a* to form an arm 16*b* which is crimped over the exposed terminal wire portion 18*a* of lead insulated wire lead 18. The leads 18–19 extend from the contacts 16–17 out the sides of the plug body through a boss portion 10*d* to connect with the sockets of the first and last light in a string of lights.

Figure 8:
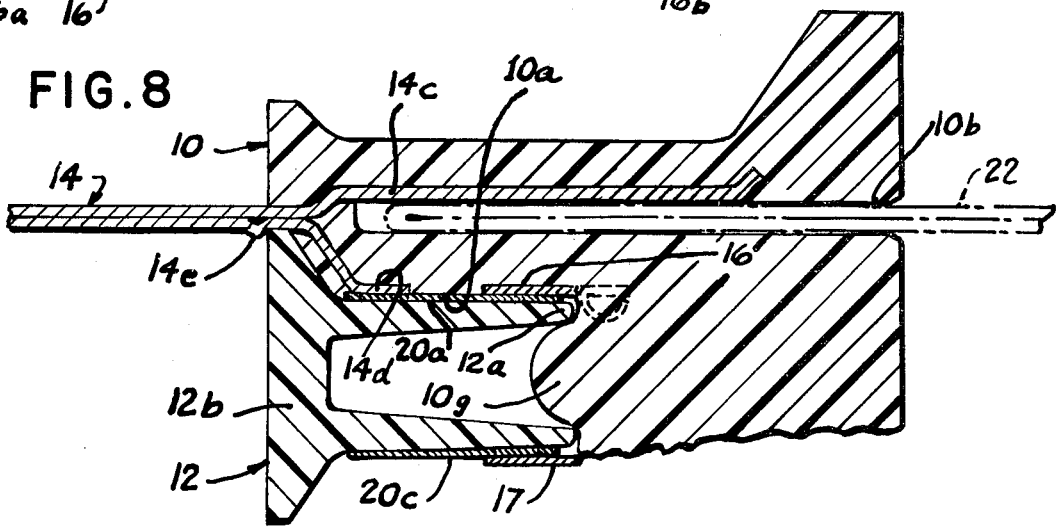
FIG. 8 is an enlarged fragmentary longitudinal sectional view taken as indicated by line 8—8 in FIG. 2.

It will be noted that the front portion of the plug body 10 between the prongs 14–15 is recessed and tapered to the mouth of the fuse socket 10*a* to match the enlarged head 12*b* of the fuse unit. The width of the front part of the plug body 10 is given the same dimension as the standard distance between the prongs 14–15 so that the square head 12*b* will extend on two of its side edges to the sides 10*e*, 10*f* of the plug body while its other two side edges extend into frictional engagement with the opposing inner faces of the prongs 14–15. This frictional engagement together with a relatively snug fit of the fuse body 12 in the fuse cavity 10*a* keeps the fuse unit 12 in pushed-in position relative to the plug body 10. If desired, one or both of the prong members 14–15 can be dimpled inwardly adjacent the top face of the fuse body to provide a small locking knob 14*e* (FIG. 8). The fuse body is molded from a sufficiently resilient plastic as to permit the enlarged head 12*b* to pass the knob 14*e* when the fuse unit is pushed into the fuse socket 10*a*. In this regard, it is also preferred to have the fuse body hollow through a major part of its length so that it can yield inwardly to allow for a snug fit of the fuse body in the fuse cavity so that there will be good contact between the fuse elements 10*a*, 10*c* and the wire contacts 16–17 and prong contact portions 14*d*, 15*d*. At the inner end of the fuse socket 10*a* it is preferred to provide a projecting portion 10*g* extending into the open end of the fuse body 12*a* to guarantee separation of the adjacent ends of the fuse elements 20*a*, 20*c*. The fuse elements 20*a–d* are formed from zinc or aluminum foil about 0.001 inches thick and are secured by a suitable adhesive to the fuse body. The exact thickness and width of the fuse elements of course depend upon the desired fuse rating.

It will be appreciated that the plug body 10 can be injection molded in one piece with the prong members 14–15 and contacts 16–17 and connected wires 18–19 in place in the mold. The body of the fuse 12 can also be injection molded as one piece whereupon the fuse elements 10*a–d* are attached as by a suitable pressure sensitive adhesive. Hence the plug assembly need only have two plastic parts.

If one of the fuse elements 20*a*, 20*c* should sever because of an overload or short circuit, after the difficulty is corrected, the spare elements 20*b*, 20*c* can be placed in operation merely by removal of the fuse unit, turning it ninety degrees, and pushing it back into the fuse socket as before. To assist in removal of the fuse unit when desired, the portions 10*e'*, 10*f'* at the front edges of the sides 10*e*, 10*f* of the plug body can be beveled to expose the underside of the overlying portions of the enlarged head 12*b* of the fuse body.

I claim:

1. A fused plug assembly comprising:

a plug body formed with a pair of parallel spaced elongated prong sockets open to one end of the plug body and a central elongated fuse socket having a mouth open to the opposite end of the plug body, a pair of parallel spaced prong members projecting as prongs from said opposite end of the plug body in alignment with said prong sockets, said prong members each having two legs within the plug body, one leg being exposed to a respective of said prong sockets and the second leg being exposed by a contact portion to the fuse socket, a pair of wire leads extending from the plug body between the ends of the latter and having a pair of spaced wire contacts connected thereto, said wire contacts being exposed to said fuse socket in general alignment with and spaced from respective of said contact portions, and a push-in fuse unit having a fuse body generally square in cross-section slidably received in the fuse socket with its head located between said prongs, said unit having a pair of spaced elongated fuse elements on opposite sides of said fuse body each arranged to engage a said contact portion and respective wire contact, and having spare fuse elements on the sides thereof between said opposite sides of the fuse body.

2. A fused plug assembly according to claim 1 in which said fuse body is hollow through part of its length.

3. A fused plug assembly comprising, a plug body formed with a fuse socket having a mouth at one end of the body, said fuse socket having two pairs of opposite sides, two respective spaced electrical contacts on each side of one of said pairs, a push-in fuse unit having a fuse body slidably mounted in said fuse socket and generally conforming to the shape thereof, said unit having respective fuse elements along each of its sides arranged to provide two fuse elements engaging the contacts at opposing sides of the fuse socket and to provide two spare fuse elements therebetween, a pair of prongs projecting from the plug body at opposite sides of said mouth and connected to two of said contacts, and conductor means connected to the other two contacts.

4. A fused plug assembly according to claim 3 in which the plug body is recessed around the mouth of the fuse socket and the fuse body has an enlarged head in the recess exposed at its sides between said prongs for being gripped for removal of the fuse unit from the fuse socket.

5. A fused plug assembly according to claim 4 in which said fuse body and its enlarged head are generally square and the enlarged head engages opposed faces of the prongs.

6. A fused plug assembly according to claim 3 in which the fuse body is hollow through a major part of its length for flexibility.

7. A fused plug assembly comprising:

a plug body formed with a central fuse socket having an exposed mouth, a pair of coplanar, spaced prong members projecting as prongs from one end of the plug body, said prong members each being exposed by a contact portion to the fuse socket, a pair of wire leads extending from the plug body and having a pair of spaced wire contacts exposed to said fuse socket in general alignment with and spaced from respective of said contact portions, and push-in fuse means having a fuse body slidably received in the fuse socket, said—fuse means—having an active pair of spaced fuse elements mounted directly on said fuse body and each arranged to engage a said contact portion and respective wire contact, said fuse—means—also having a spare pair of fuse elements mounted directly on the fuse body and arranged to become active responsive to removal of the fuse unit from the fuse socket, changing the orientation of the fuse—means—relative to the socket to a reoriented position in which said spare fuse elements occupy the position previously occupied by said active fuse elements, and then reinserting the reoriented fuse—means—.

8. A fused plug assembly according to claim 7, in which said fuse body is generally square in cross-section and said active fuse elements are on one pair of opposite sides of said square and the spare fuse elements are on the other pair of opposite sides of said square.

* * * * *